US006231168B1

(12) United States Patent
Maze et al.

(10) Patent No.: US 6,231,168 B1
(45) **Date of Patent: *May 15, 2001**

(54) INK JET PRINT HEAD WITH FLOW CONTROL MANIFOLD SHAPE

(75) Inventors: Robert C. Maze; Douglas M. Collins; Todd A. Cleland, all of Corvallis, OR (US); Leslie A. Field, Portola Valley, CA (US); Storrs T. Hoen, Brisbane, CA (US); Phillip W. Barth, Portola Valley, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/303,250

(22) Filed: Apr. 30, 1999

(51) Int. Cl.[7] ..... B41J 2/05
(52) U.S. Cl. ..... 347/65
(58) Field of Search ..... 347/63, 65, 67, 347/84–85, 92, 47

(56) References Cited

U.S. PATENT DOCUMENTS

| | | | | |
|---|---|---|---|---|
| 4,931,811 | | 6/1990 | Cowger et al. | 347/87 |
| 5,317,346 | | 5/1994 | Garcia | 347/63 |
| 5,350,616 | | 9/1994 | Pan et al. | 428/131 |
| 5,387,314 | | 2/1995 | Baughman et al. | 216/27 |
| 5,450,109 | * | 9/1995 | Hock | 347/67 |
| 5,463,413 | | 10/1995 | Ho et al. | 347/65 |
| 5,666,143 | | 9/1997 | Burke et al. | 347/65 |
| 5,734,399 | | 3/1998 | Weber et al. | 347/65 |
| 5,793,393 | | 8/1998 | Coven | 347/65 |
| 5,815,185 | | 9/1998 | Pietrzyk | 347/92 |
| 5,874,974 | * | 2/1999 | Courian et al. | 347/65 |

OTHER PUBLICATIONS

Ronald A. Askeland, et al. "The Second–Generation Thermal InkJet Structure" Hewlett–Packard Journal, Aug. 1988, pp. 28–31.

William A. buskir, et al. "Development of a High–Resolution Thermal Inkjet Printhead", Hewlett–Packard Journal, Oct. 1988, pp. 55–61.

J. Stephen Aden, et al. "The Third–Generation HP Thermal InkJet Printhead" Hewlett–Packard Journal, Feb. 1994, pp. 41–45.

* cited by examiner

*Primary Examiner*—John Barlow
*Assistant Examiner*—Juanita Stephens

(57) ABSTRACT

An ink jet print head with a substrate defining an ink aperture. A number of ink energizing elements are located on the major surface of the substrate. A barrier layer is connected to the upper surface, and peripherally encloses an ink manifold. The barrier encompasses the ink aperture. An orifice plate is connected to the barrier layer, spaced apart from the substrate's major surface, enclosing the ink manifold. The plate defines a number of orifices, each associated with a respective ink energizing element. The ink manifold is an elongated chamber having opposed ends defined by end wall portions of the barrier layer. The barrier end wall portions each have an intermediate end wall portion protruding into the manifold.

14 Claims, 4 Drawing Sheets

INK JET PRINT HEAD WITH FLOW CONTROL MANIFOLD SHAPE

FIELD OF THE INVENTION

This invention relates to ink jet printers, and more particularly to ink jet printers with thermal ink jet print heads.

BACKGROUND AND SUMMARY OF THE INVENTION

Ink jet printers employ pens having print heads that reciprocate over a media sheet and expel droplets onto the sheet to generate a printed image or pattern. A typical print head includes a silicon chip substrate having a central ink hole that communicates with an ink filled chamber of the pen when the rear of the substrate is mounted against the pen. An array of firing resistors are positioned on the front of the substrate, within a chamber enclosed peripherally by a barrier layer surrounding the resistors and the ink aperture. An orifice plate connected to the barrier just above the front surface of the substrate encloses the chamber, and defines a firing orifice just above each resistor. Additional description of basic printhead structure may be found in "The Second-Generation thermal Inkjet Structure" by Ronald Askeland et al. in the Hewlett-Packard Journal, August 1988, pages 28–31; "Development of a High-Resolution Thermal Inkjet Printhead" by William A. Buskirk et al. in the Hewlett-Packard Journal, October 1988, pages 55–61; and "The Third-Generation HP Thermal Inkjet Printhead" by J. Stephen Aden et al. in the Hewlett-Packard Journal, February 1994, pages 41–45.

For a single color pen, the resistors are arranged in two parallel elongated arrays that each extend nearly the length of the substrate to provide a maximum array length for a given substrate chip size. The resistor arrays flank opposite sides of the ink aperture, which is typically an elongated slot or elongated array of holes. To ensure structural integrity of the substrate, the ink aperture does not extend too close to the substrate edges, nor as close to the edges as the endmost several firing resistors. Therefore, several resistors at each end of each array extend beyond the end of the ink supply aperture or slot.

While a reasonably effective configuration, it has been found that the end firing elements, that is, those that include the end resistors, are more susceptible to failure than are the multitude of firing elements that adjoin the length of the ink supply slot. It is believed that small air bubbles come primarily from two sources: those that arise from outgassing of ink components during normal operation, and those left behind after completion of pen assembly. These bubbles tend to aggregate and coalesce into larger bubbles in ends of the ink chamber. This occurs in the portions beyond the ends of the ink supply slots, and in the vicinity of the end resistors. Small bubbles present are normally tolerated because they can be "ejected," with only a single ink droplet being omitted from printed output; the firing element then continues properly following the momentary tolerable failure. However, it is believed that when the small tolerable bubbles are permitted to coalesce, they become large enough to permanently block one or more firing elements, preventing ink from reaching a firing resistor.

In addition, the ink chamber region beyond the ends of the ink supply slot are believed to create a stagnant zone of ink, and to have a lower ink flow velocity to the endmost firing elements.

The present invention overcomes the limitations of the prior art by providing an ink jet print head with a substrate defining an ink aperture. A number of ink energizing elements are located on the major surface of the substrate. A barrier layer is connected to the upper surface, and peripherally encloses an ink manifold. The barrier encompasses the ink aperture. An orifice plate is connected to the barrier layer, spaced apart from the substrate's major surface, enclosing the ink manifold. The plate defines a number of orifices, each associated with a respective ink energizing element. The ink manifold is an elongated chamber having opposed ends defined by end wall portions of the barrier layer. The barrier end wall portions each have an intermediate end wall portion protruding into the manifold.

DETAILED DESCRIPTION OF A PREFERRED EMBODIMENT

Figure 1:
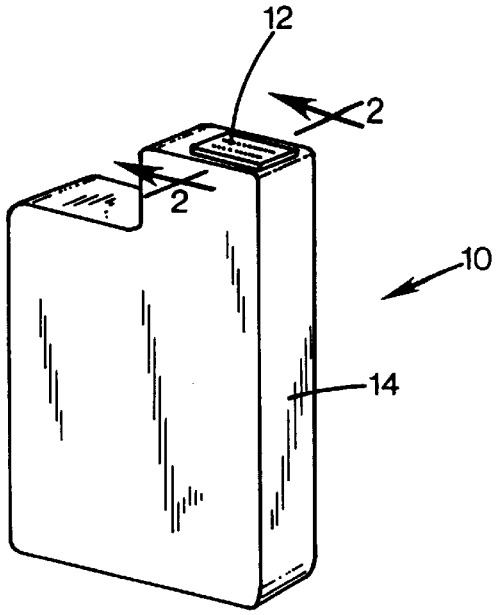
FIG. 1 is a perspective view of an ink jet pen according to a preferred embodiment of the invention.

FIG. 1 shows an ink jet pen 10 having an print head 12. The pen has a pen body 14 defining a chamber containing a supply of ink, which is supplied to the print head. An electrical interconnect (not shown) provides connection between a printer in which the pen is installed and the print head, so that the print head may control printing by the print head.

Figure 2:
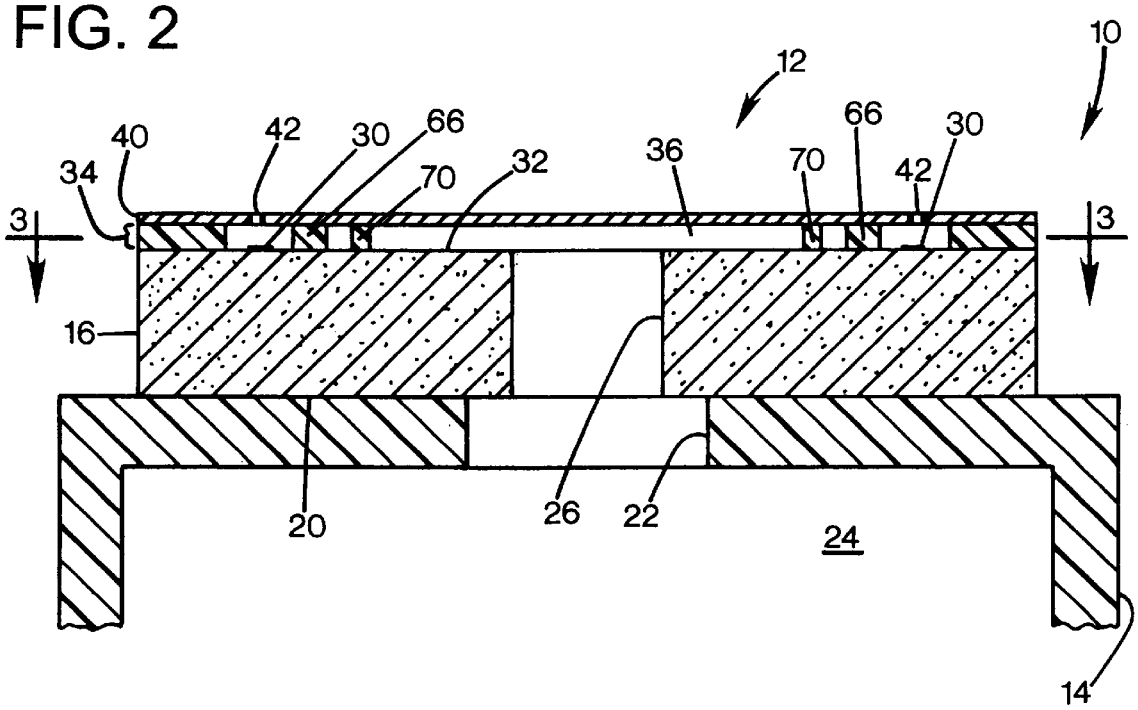
FIG. 2 is an enlarged sectional view of a print head taken along line 2—2 of FIG. 1.

FIG. 2 shows the print head in cross section. The print head includes a silicon substrate 16 having a rear surface 20 mounted to the pen body. An ink outlet 22 in the pen body opens into the ink chamber 24. The substrate defines an ink channel 26 registered with the ink outlet 22. A number of firing resistors 30 are located on an upper surface 32 of the substrate, arranged in rows on opposite sides of the ink channel 26. A barrier layer 34 is attached to the upper surface of the substrate, and covers the periphery of the substrate to laterally enclose an ink manifold chamber 36, encompassing the resistors 30. The barrier has various features and important pattern details that will be discussed below. An orifice plate 40 is attached atop the barrier layer 34 to enclose the manifold chamber 36. The orifice plate defines arrays of ink orifices 42, each of which is registered with a respective firing resistor 30. In the preferred embodiment, the orifice plate is 25 microns thick, and the barrier layer is 14 microns thick, although alternatives may be used, and the drawings is not to scale.

Figure 3:
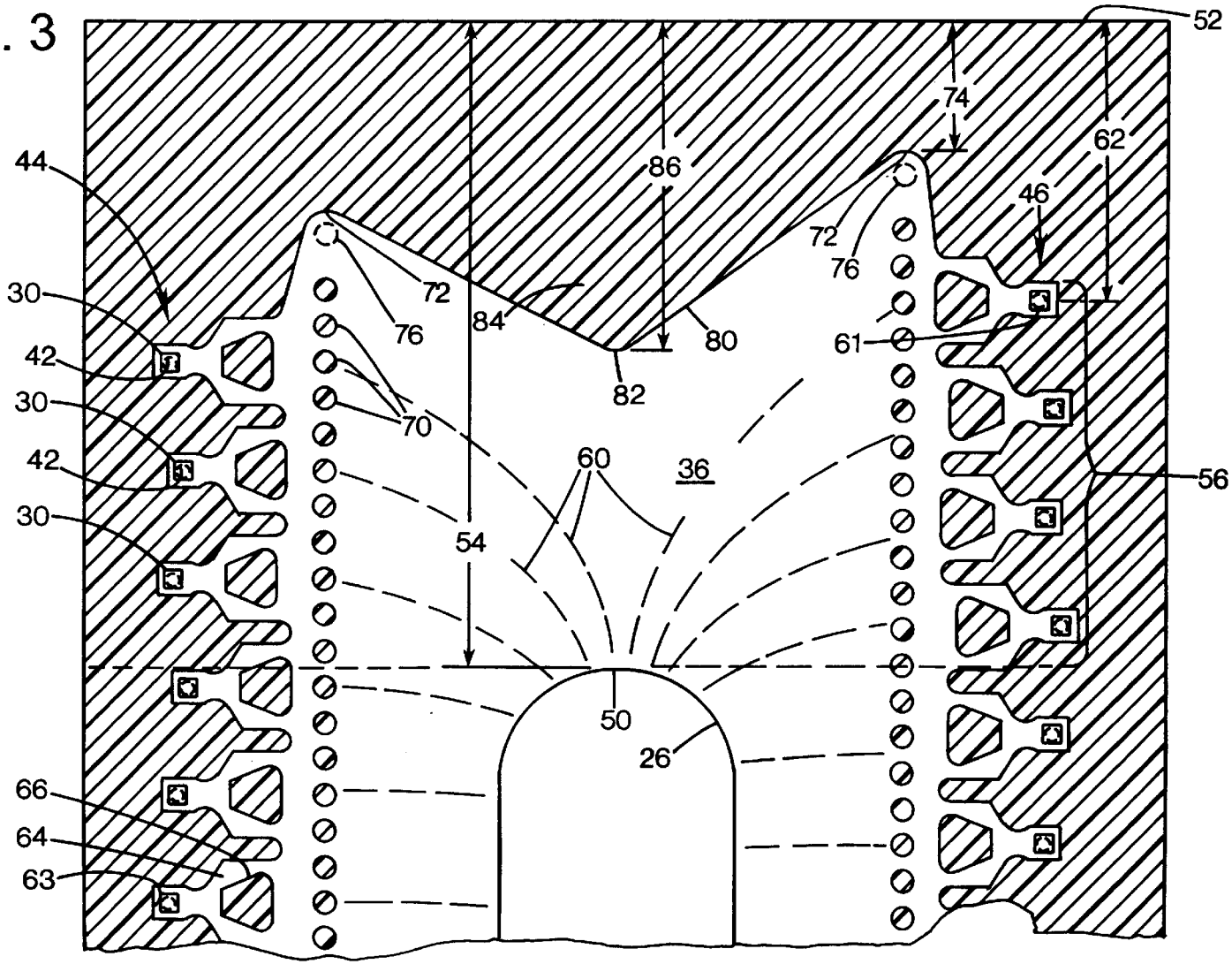
FIG. 3 is an enlarged sectional view of a print head taken along line 3—3 of FIG. 2.

FIG. 3 shows the barrier layer and substrate at one end of the print head. The other end is the same, with numerous intermediate features repeated between the ends. The resistors 30 are arranged in a first row 44 and a second row 46, with the resistors being evenly spaced apart in each row. The rows are axially offset by one-half of the resistor spacing to provide an evenly alternating arrangement that provides a higher resolution printed swath. The substrate in supply slot 26 is an elongated oblong, with only a single end shown. In alternative embodiments, it may be an array of end-to-end oblong or circular holes having the same total end-to-end length. The slot end 50 is spaced apart from the substrate edge 52 by a slot spacing distance 54. This must be more than a minimal amount to ensure that the substrate has structural integrity against breakage.

An end resistor zone 56 extends beyond the end of the slot 26, and includes several resistors (in this embodiment a total of eight resistors.) These end resistors do not receive ink flow from the ink slot 26 on a direct lateral path as do the remaining resistors. The end resistors receive ink flow that takes a longer path 60 having a directional component parallel to the slot axis. The most remote resistor 61 is spaced apart from the substrate edge 52 by a spacing 62. This spacing is as small as possible to provide a wide swath from a given substrate dimension, to minimize component costs.

The barrier defines a firing chamber 63 for each resistor. The firing chamber extends laterally away from the manifold 36, and is connected via an antechamber 64 containing a flow control wedge 66 formed as part of the barrier layer. The wedge creates tapered ink passages that provide redundant flow paths. A row of barrier pillars 70 is positioned between the ink supply slot and the firing chambers, and serves to deter passage of any contaminant particles or larger air bubbles into the firing chambers.

At the end of the manifold chamber 36 along each major edge defined by the pillars 70, the manifold terminates in corners 72. The most remote corner extends to within a spacing 74 from the substrate edge 52, and each corner encompasses an optional non-firing orifice 76 in the orifice plate above, so that air trapped may be released from the manifold. The spacing 74 is minimized to provide efficient substrate usage as noted above, and is limited by tolerances and the need for a minimum width of barrier material to ensure the integrity of the manifold seal.

At the ends of the manifold, the barrier forms an end wall 80 that protrudes inwardly into the manifold at a central vertex 82, Thus, a wedge 84 of barrier material extends into the manifold. The vertex of the wedge is spaced apart from the substrate edge 52 by a spacing 86, which is greater than the end resistor spacing 62. The vertex protrudes sufficiently to intervene between the endmost resistors of each row, and extends beyond the manifold corner 72 by a distance (equal to spacing 86 minus spacing 74) of about four times the pitch of the resistors. The vertex protrudes toward the slot end 50 to narrow that distance (measured by spacing 54 minus spacing 86) to less than two-thirds of what it would be if the end wall 80 extended straight between the corners 72.

By occupying part of what would have been a vacant manifold portion, the protrusion or wedge fills a location where ink flow would have been slow or stagnant, and where small bubbles may have aggregated and coalesced. By eliminating this stagnant region, the remaining manifold regions are continually flushed by the ink supply as the resistors fire. This prevents microscopic any air bubbles that may normally arise from coalescing into large air bubbles that would otherwise begin to fill the manifold ends, and eventually block some of the end nozzles. In addition, by forcing a reduced path length to the end nozzles, the wedge reduces the time the ink spends in the manifold at the ends, limiting the amount of time in which it may outgas air bubbles.

In the preferred embodiment, the print head includes 144 resistors, with a spacing of $1/300^{th}$ inch or 84.67 microns between adjacent resistors in a row, for an effective spacing of half that amount. The overall length of the print head is 8680 microns, with a slot length of 5690 microns, for a slot end spacing 54 of 1495 microns. The slot end spacing should be no less than about 1345 microns to minimize susceptibility to cracking at the slot ends. In the preferred embodiment, there are eight resistors in the end section 56 at each end. The endmost resistor is centered at a spacing 62 of 930 microns from the substrate edge. The comer 72 of the manifold is at a spacing 74 of 815 microns from the edge, and the vertex 82 extends 970 microns from the edge.

Figure 4:
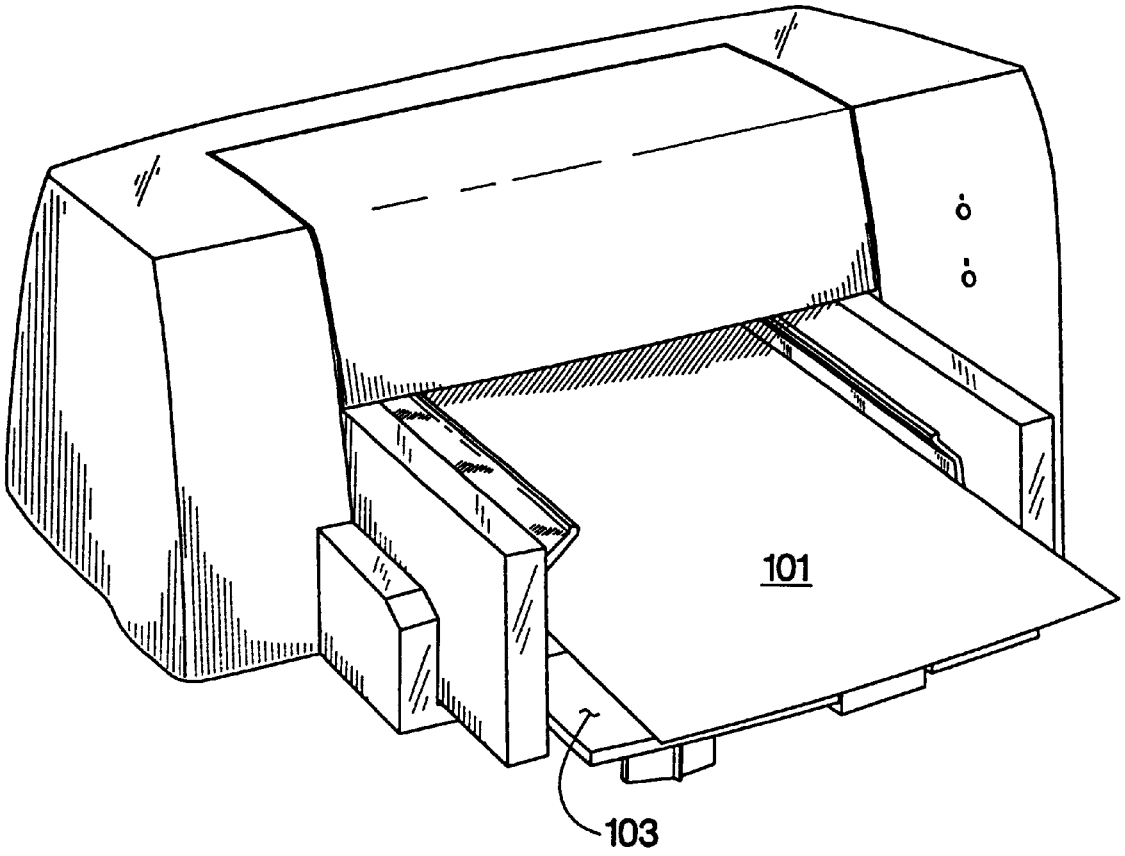
FIG. 4 is an isometric drawing of a typical printer which may employ an ink jet pen utilizing the present invention.
Figure 5:
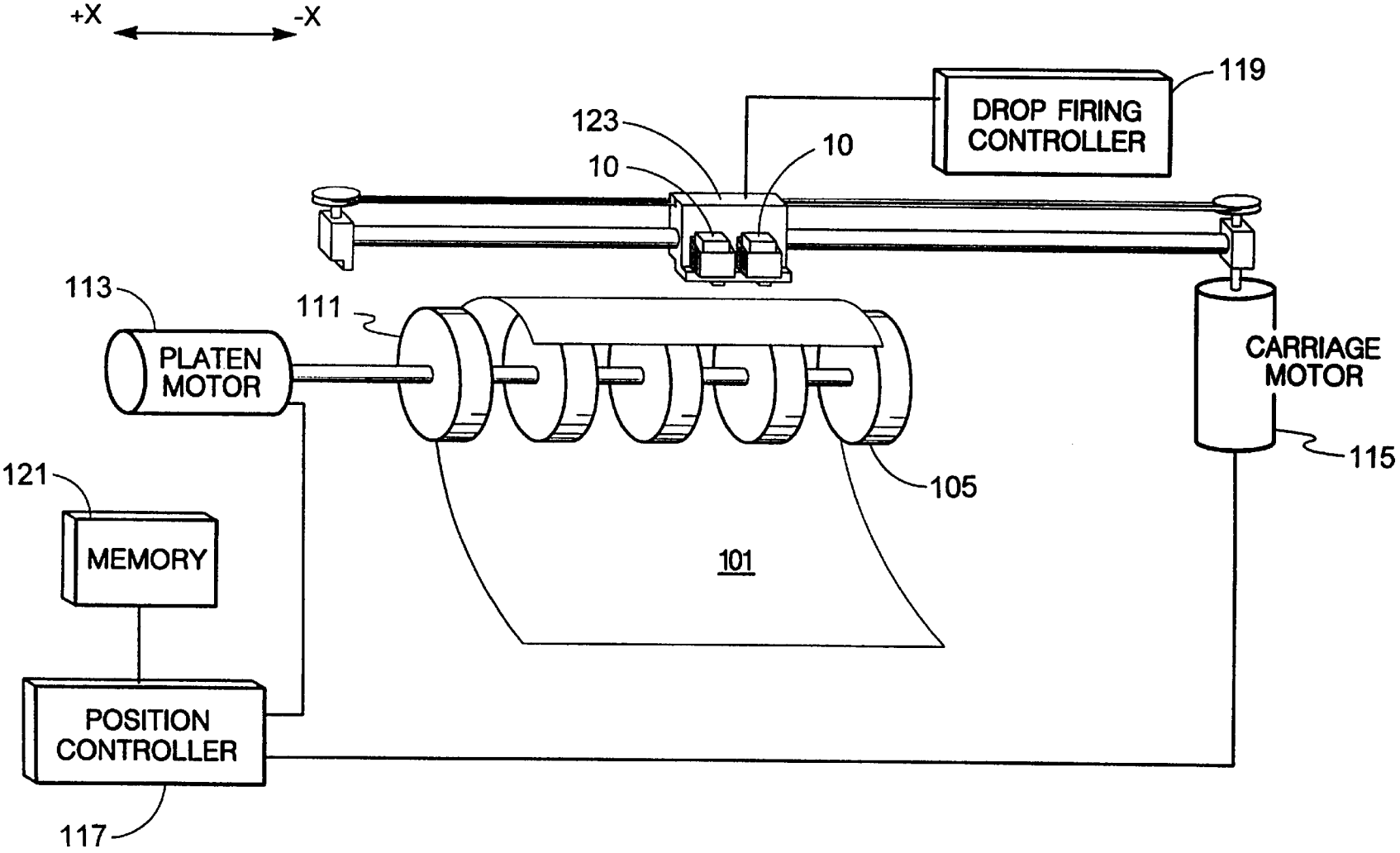
FIG. 5 is a schematic representation of a printer which may employ the present invention.

An inkjet printer which may employ the present invention is illustrated in the isometric drawing of a typical inkjet printer shown in FIG. 4. Paper or other media 101, which may be printed upon, is stored in the input tray 103. Referring to the schematic representation of a printer of FIG. 5, a single sheet of media is advanced from a medium input 105 into a printer print area defined essentially by the printhead of inkjet pens 10 by a medium advancing mechanism including a roller 111, a platen motor 1113, and traction devices (not shown). In a typical printer, one or more inkjet pens 10 are incrementally drawn across the medium 101 on the platen by a carriage motor 115 in a direction perpendicular to the direction of entry of the medium. The platen motor 113 and the carriage motor 115 are typically under the control of a media and cartridge position controller 117. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 101 is positioned in a location so that the pens 10 may eject droplets of ink to place dots on the medium as required by the data that is input to a drop firing controller 119 of the printer. These dots of ink are expelled from the selected orifices in a printhead element of selected pens in a band parallel to the scan direction as the pens 10 are translated across the medium by the carriage motor 115. When the pens 10 reach the end of their travel at an end of a print swath on the medium 101, the medium is typically incrementally advanced by the media and cartridge position controller 117 and the platen motor 113. Once the pens have reached the end of their traverse in the X direction on a bar or other print cartridge support mechanism, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the pen, and selection of the correct ink ejectors of the printhead for creation of an ink image or character is determined by the controller 117. The controller may be implemented in a conventional electronic hardware configuration and provided operating instructions from conventional memory 121. Once printing of the medium is complete, the medium is ejected into an output tray of the printer for user removal.

While the above is discussed in terms of preferred and alternative embodiments, the invention is not intended to be so limited. For instance, although shown as a single printhead for a single ink color, a print head may be provided with multiple portions like that shown on a single substrate. Each may have a single ink supply slot connected to its own pen ink chamber, and flanked by rows of nozzles dedicated to that color. In addition, the end wall protrusion may have any protruding shape that reduces the manifold volume along the midline at the end, or which serves to direct ink flow on a more direct path to end nozzles.

What is claimed is:

1. An ink jet print head comprising:

a substrate defining an ink aperture and having a major surface;

a plurality of ink energizing elements on the major surface of the substrate;

a barrier layer connected to the major surface, peripherally defining an ink manifold, and encompassing the ink aperture;

an orifice plate connected to the barrier layer, spaced apart from the substrate major surface, enclosing the ink manifold, and defining a plurality of orifices, each associated with a respective ink energizing element;

the ink manifold being an elongated chamber having opposed ends defined by end wall portions of the barrier layer; and the barrier end wall portions each having an intermediate end wall portion protruding into the manifold.

2. The print head of claim 1 wherein the ink aperture has an end portion spaced apart from a peripheral edge of the substrate by a first amount and wherein the barrier end wall portion is spaced apart from the peripheral edge by a lesser second amount.

3. The print head of claim 1 wherein the ink energizing elements are arranged in a linear array parallel to the ink manifold, and wherein the array extends beyond the intermediate end wall portions.

4. The print head of claim 3 including two linear arrays of ink energizing elements, each array positioned on an opposite side of the ink aperture.

5. The print head of claim 1 wherein the end wall portions includes two flat end wall portions articulated at an angle to provide a wedge shape intruding into the manifold.

6. The print head of claim 1 wherein the periphery of the manifold has opposed major edges, each defining an array of extending chambers, each chamber encompassing a respective ink energizing element.

7. An ink jet print head comprising:

a substrate defining an elongated ink aperture portion having opposed ends, and the substrate having a major surface;

a plurality of ink energizing elements on the major surface of the substrate in two elongated rows on opposite sides of the ink aperture;

a barrier layer connected to the major surface, and peripherally defining an elongated ink manifold encompassing the ink aperture;

the ink manifold being an elongated chamber having opposed ends defined by end wall portions of the barrier layer; and the rows of ink energizing elements including respective first and second end elements at each end, and the barrier end wall portions each including a protrusion extending between the first end element of one row, and the second end element of the other row.

8. The print head of claim 7 wherein at least one row of ink energizing elements extends beyond the ends of the ink aperture.

9. The print head of claim 7 including an orifice plate attached to the barrier layer to enclose the manifold, and defining a plurality orifices, each associated with a respective ink energizing element.

10. The print head of claim 7 wherein the ink aperture has an end portion spaced apart from a peripheral edge of the substrate by a first amount and wherein the barrier end wall portion is spaced apart from the peripheral edge by a lesser second amount.

11. The print head of claim 10 including two linear arrays of ink energizing elements, each array positioned on an opposite side of the aperture.

12. The print head of claim 7 wherein the end wall portions includes two flat end wall portions articulated at an angle to provide the protrusion.

13. The print head of claim 7 wherein the periphery of the manifold has opposed major edges, each defining an array of extending chambers, each chamber encompassing a respective ink energizing element.

14. An ink jet printer comprising:

an inkjet printhead comprising:

a substrate defining an ink aperture an having a major surface, a plurality of ink energizing elements on the major surface of the substrate, a barrier layer connected to the major surface, peripherally defining an ink manifold, and encompassing the ink aperture, an orifice plate connected to the barrier layer, spaced apart from the substrate major surface, enclosing the ink manifold, and defining a plurality of orifices, each associated with a respective ink energizing element, the ink manifold being an elongated chamber having opposed ends defined by end wall portions of the barrier layer, and the barrier end wall portions each having an intermediate end wall portion protruding into the manifold;

a printhead carriage; and a printhead position controller.

* * * * *

UNITED STATES PATENT AND TRADEMARK OFFICE

CERTIFICATE OF CORRECTION

PATENT NO. : 6.231,168 B1
DATED : May 15, 2001
INVENTOR(S) : Maze et al.

It is certified that error appears in the above-identified patent and that said Letters Patent is hereby corrected as shown below:

Column 6,
Line 29, delete “an” and insert in lieu thereof -- and --.

Signed and Sealed this

Fifteenth Day of June, 2004

JON W. DUDAS
*Acting Director of the United States Patent and Trademark Office*